United States Patent [19]

Schmidt et al.

[11] 4,050,980

[45] Sept. 27, 1977

[54] SELECTIVE DELAMINATION OF WOOD CHIPS

[75] Inventors: Fred L. Schmidt; Frank J. Steffes, both of Camas, Wash.

[73] Assignee: Crown Zellerbach Corporation, San Francisco, Calif.

[21] Appl. No.: 666,823

[22] Filed: Mar. 15, 1976

Related U.S. Application Data

[63] Continuation-in-part of Ser. No. 527,772, Nov. 27, 1974, abandoned.

[51] Int. Cl.[2] ..... D21C 1/10

[52] U.S. Cl. ..... 162/24; 162/55; 162/56; 241/24; 241/28

[58] Field of Search ..... 162/18, 24, 55, 56, 162/28; 241/21, 24, 27, 28, 76, 77, 79, 80, 81; 209/2, 10, 392, 397

[56] References Cited

U.S. PATENT DOCUMENTS

| | | | |
|---|---|---|---|
| 2,374,046 | 4/1945 | Stacom | 241/24 X |
| 2,862,813 | 12/1958 | Birdseye | 162/18 |
| 3,224,925 | 12/1965 | Brandts et al. | 241/24 X |
| 3,367,495 | 2/1968 | Lea et al. | 162/55 X |
| 3,393,634 | 7/1968 | Blackford | 162/28 X |
| 3,411,720 | 11/1968 | Jones et al. | 241/28 |

FOREIGN PATENT DOCUMENTS

| | | | |
|---|---|---|---|
| 677,418 | 1/1964 | Canada | 162/18 |

OTHER PUBLICATIONS

Colombo et al., "Effects of Mechanical Chips Treatment on Pulp & Paper for Kraft Cooking of Softwood," Svensk Papperstidning, vol. 63, No. 15, pp. 457–471; 8/1960.

*Primary Examiner*—Arthur L. Corbin
*Attorney, Agent, or Firm*—Jerome S. Marger; Corwin R. Horton

[57] ABSTRACT

A wood chip stream capable of being selectively delaminated is produced by separating a mill-wood chip stream into respective first and second fractions on the basis of wood chip thickness. The first fraction consisting of wood chips having a predetermined thickness, is then pulped by conventional techniques. The wood chips in the second fraction are reduced to said predetermined thickness and are then selectively delaminated by compression means. After being subjected to selective delamination, the delaminated chips are pulped by conventional techniques. Accordingly, a high yield, uniform wood pulp having reduced pulp screen rejects is produced.

10 Claims, 1 Drawing Figure

SELECTIVE DELAMINATION OF WOOD CHIPS

CROSS REFERENCE TO RELATED APPLICATION

This is a continuation-in-part of U.S. Pat. application Ser. No. 527,772, filed Nov. 27, 1974 now abandoned.

BACKGROUND OF THE INVENTION

U.S. Pat. No. 3,393,634 to Blackford describes a method and apparatus for loosening fibers and wood chips. For purposes of contrasting his process, Blackford describes a general method for kraft pulping in column 1, lines 12–22, inclusively. Blackford goes on to state that feed chips in any given batch vary considerably as to size, especially the length and larger transverse dimensions. And, because of the dimensional differences between respective chips, overcooking or undercooking of the chips, or, alternatively, longer cooking times and lower pulp yields, will result. A further problem resides in the presence of compression and knot wood which require even longer cooking times in order to achieve the requisite degree of pulping. Therefore, these latter materials generally need recycling through the pulping system several additional times in order to achieve the desired pulp quality. This is, of course, a distinct economic problem to the entire pulp and paper industry and is even more acute in older, recovery-limited mills where capacity is at a premium.

Mechanical methods have been employed in reducing the gross size of the chips fed to the pulping operation. The prior art suggests, however, that any significant amount of additional chipping of the feed chip stream causes excess damage to the cellulosic fiber itself, which in turn reduces the strength properties of the paper produced therefrom to a point below specified minimums.

In his patent, Blackford provides an apparatus which compresses the feed chip stream to a fraction of its original thickness without damaging, to any substantial degree, the fibers which form the chip structure. This means of compression of the chips loosens the fibers and renders the chips more porous and accessible to pulping liquor penetration. The apparatus employed by Blackford is shown in FIGS. 1–4, and described in detail in column 2, lines 10–48.

The Blackford process, as its overall objectives, provides a method and apparatus for controled compression of the above described chips to promote delamination thereof. For purposes of the present invention, delamination is defined as "compression by cleavage in a plane parallel to the fibers so that they are not substantially damaged by the mechanical forces imparted to them." By loosening and exposing the fibers, Blackford states, through compressive delamination, "the cooking liquid can penetrate the chips and affect the lignin uniformly throughout the chips irrespective of their size (emphasis added), thereby obtaining faster cooking, more uniform pulp, no uncooked shives, increasing the yield of pulp, and to render the moisture content of the chips more uniform." Therefore, the pulping yield will depend to a great extent on the degree to which the chips are delaminated, especially the troublesome knot wood and compression-wood chips.

Although the above objectives are accomplished to a certain extent by Blackford, several problems are present, however, when the above process is employed. Because of the variation in the size of the chips in the feed stream, a given opening formed between the press roll, i.e., the nip, cannot efficiently and effectively compress and delaminate the total size spectrum of entering chips. This problem results from the critical relationship required between the nip size and the thickness of the chips in order to effectuate the requisite degree of delamination. Blackford states that the space between the rolls should be approximately one-hundredth to five-hundredth inch. In addition, he goes on to say that the space between the rolls is small enough to compress the chips "to at least approximately one-fifth of their original thickness but not more than approximately one-tenth of their original thickness . . . ." Accordingly, if the space between the rolls is calibrated to compress the larger chip fraction of the total stream, i.e., chips having a thickness greater than one-half inch, a substantial amount of the smaller sized fraction, which represents a majority of the chip stream, including compression wood and knots, will pass through the nip without being effectively delaminated. As will be evident from the data hereinafter presented, the above smaller sized chip portion represents about 86% of the total chip feed stream. On the other hand, if the nip is set for compression of the majority fraction, i.e., chips having a thickness of less than one-fourth inch, a substantial amount of the larger chip fraction will suffer mechanical damage and/or, if the resistance to deformation of the chips exceeds the frictional forces attempting to draw them through the nip, will slide back and forth between the rolls until they are physically removed. Moreover, while the large chips are stymied, other smaller chips will drop through the nip opening uncrushed, or, alternatively, will pile up behind the stagnant chip. This, of course, will cause an interruption in the continuous operation of the process, thereby reducing the efficiency of delamination of the system. More specifically, the efficiency of delamination is a measure of the through-put, in tons per day per linear foot of machine width, of the chips compressed by a given process. Preferably, the through-put will be at least 75 tons per day, and more preferably at least 25 tons per day, per linear foot of roll press width. In any case, the overall yield of product, based on the efficiency of delamination, final product pulp conversion, and physical properties of the sheets produced therefrom, respectively, is substantially lower for the prior art processes than for the process of the present invention.

Colombo et al., in Canadian Pat. No. 677,418, and in an article entitled "Effects of Mechanical Chips Treatment on Pulp and Paper for Kraft Cooking of Softwood" in Svensk Papperstidning, Volume 63, No. 15, pages 457–471 (August 1960), also recognize the need for controlling clearance and pressure between the cylinders of an apparatus similar to that employed in the Blackford patent. However, Colombo et al. further provide, in order to minimize mechanical damage, that the chips be moved through a series of press rolls, of decreasing clearances, in which the chips are successively subjected to decreasing amounts of radial compressive forces, well below their respective elastic limit. Minimizing initial chipping operation is also suggested by Colombo. This is accomplished by adjusting the chippers to produce big chips and reducing the small sized fraction. The process also includes the separation of the feed chip stream into respective large and small fractions prior to employing successive compression steps. Because of this initial separation step, the feed stream contains a significantly greater proportion of large sized chips than in either Blackford or in the process of this invention. Chip fraction and chip thickness distribution data, with respect to the process of this invention, will be hereinafter set forth to illustrate this difference. Moreover, it is estimated that a series of about six to 10 pairs of cylindrical roll presses would be required to sequentially delaminate initial chip feed, step-by-step, in preparation for pulping. Therefore, in this roll press series, a greater potential exists for any of the problems present in the Blackford process to interrupt and materially affect the compression sequence of Colombo. This, indeed, is a significant problem since the Colombo process is quite complex to operate and exceedingly costly to install and maintain.

U.S. Pat. No. 3,070,318 to Blanchard provides a system for removing bark from chips in which the chips are first debarked and compressed simultaneously between a pair of rolls 1 and 2, roll 2 being knurled. The material exiting the rolls is then separated into two fractions by an inclined screen. The smaller fraction passing through the screen is again compressed and debarked using a pair of rolls similar to the aforementioned rolls 1 and 2. The compressed chips exiting the second pair of rolls is then recombined with the larger fraction which did not pass through the screen and the composite chip stream is compressed and debarked employing a third pair of press rolls. The latter pair of rolls has a tooth-in-groove peripheral configuration. The process of the Blanchard patent suffers from the above drawbacks outlined with respect to both the Blackford and Colombo processes.

SUMMARY OF THE INVENTION

This invention relates to a selective delamination process which comprises effectively and efficiently forming a more uniform feed chip stream, capable of being selectively delaminated, the pulp produced therefrom exhibiting a high, overall yield. The process includes separating by size a conventional mill-wood chip stream, via a primary separating means, into respective first and second fractions, on the basis of the hereinafter described predetermined thickness dimension.

The first fraction segregated by the primary separation means has a thickness greater than the above predetermined thickness dimension and is thus retained by the primary separating means. It is desirable that from about 5% by weight, and up to about 25% by weight, based on the total weight of the mill-wood chip stream, be retained by the primary separating means, and preferably from about 10% by weight, and up to about 20% by weight.

Th second fraction separated has a thickness not greater than the above predetermined chip thickness. After separating, the second fraction is subjected to a subsequent pulping step.

Then, prior to the selective delamination step, the first fraction is converted into a more uniform feed stream. By providing a more uniform stream, a continuous, efficient, and selective chip delamination process can be conducted, without substantial fiber damage, at substantially high through-put rates, which in turn provides the requisite high, overall yield. More specifically, after separation, the first fraction is conveyed to a means for reducing the chip size thereof on the basis of a predetermined chip thickness dimension, without departing substantial compressive forces thereto, and without substantial reduction in the fiber length of the chips. The reduced chip fraction thus formed is conveyed to a second means for separating the reduced chips by size with respect to a predetermined thickness dimension and to respective oversized and through-put chip fractions. Either one of the primary and secondary separation means may comprise a means for screening either one of the mill-wood chip stream and reduced chip fraction, respectively. Under desired circumstances, either one of the primary or secondary separating screen means can be fabricated having openings formed so that an elongated configuration is created, as opposed to standard screens having square or perforated openings, and formed so that chips having a plurality of lengths and widths, respectively, but having a predetermined thickness dimension, can pass therethrough. The oversized chip fraction retained by the secondary separating means has a thickness greater than the prescribed predetermined thickness dimension. The through-put fraction, which then advances beyond the secondary separating means, has a thickness not greater than the predetermined thickness dimension. The oversized chip fraction is reconveyed to the reducing means for further reduction without substantial damage to the fiber length of the chips. After the reduction step is completed, the reduced chips produced are reconveyed to the secondary separation means. The through-put fraction emanating from the secondary separation means, in any case, is selectively delaminated, at a substantially high through-put rate, employing a compression means. In an alternate embodiment, wherein the transverse dimension of the elongated openings in the primary screen separation means is less than the transverse dimension of the elongated openings in the secondary screen separation means, the first chip fraction is conveyed directly to the secondary separation means, prior to the size reduction step, for separating by size the first fraction into respective oversized and through-put chip fractions. The oversized fraction retained by the secondary separation means is conveyed to the reducing means while the through-put fraction is subsequently selectively delaminated. In either sequence, the delaminated chips are then subjected to subsequent pulping.

As opposed to the previously described prior art methods, other improvements resulting from employing the process of this invention include reduction of pulp stream rejects, knots, and shives; an increase in the permanganate number; and the maintenance of physical properties such as bursting strength and tear resistance. Moreover, while the above increases are being maintained, a reduction in the capital costs, the amount of caustic required to achieve a given permanganate number, the cook time, and the like, are achieved.

DETAILED DESCRIPTION OF THE PRESENT INVENTION

Figure 1:
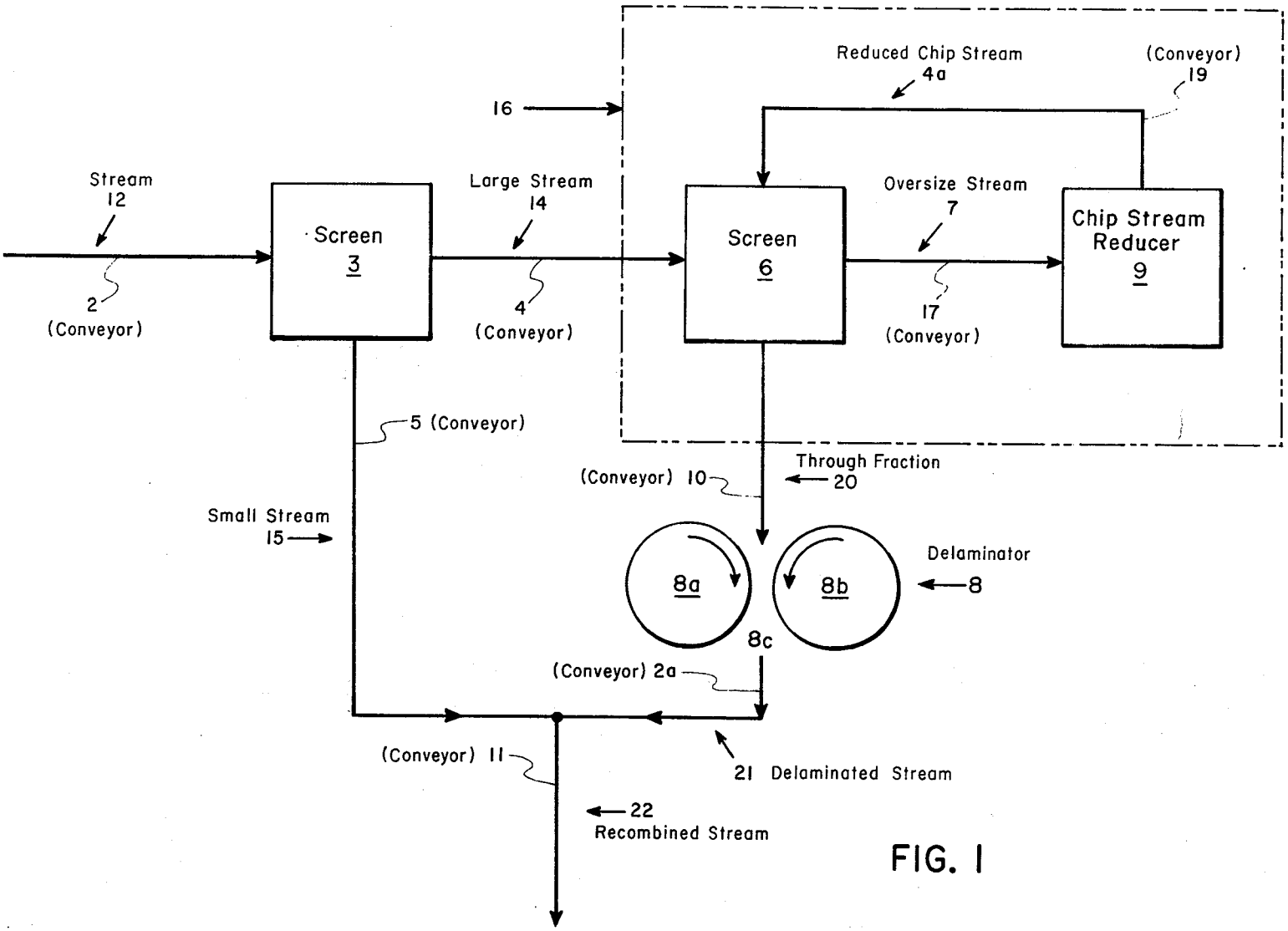

Referring now to FIG. 1, a system illustrative of the process of the present invention provides conveyor means 2 for feeding a complete mill-wood chip stream 12 to a primary means 3, such as, for example, a means for screening chip stream 12, for initially separating by size stream 12 into respective first and second fractions 14 and 15. The composition of the chips in stream 12 is substantially similar in relative proportional composition to the feed system entering hopper 9 in the previously described Blackford patent. For instance, Example 1, Table 1, provides a Williams screen analysis, according to TAPPI T-16m-54, of feed stream 12 and indicates, by weight percentage, the relative proportion of chips retained on each of a series of screens having respective openings varying from three-sixteenth inch to 1⅛ inches. The Williams screen analysis measures either the longitudinal or transverse dimensions of a given chip retained on a given screen. With reference to Table 1, Run I, for purposes of illustration, two important values with regard to chip uniformity can be obtained from the above screen fraction data. The first value is the relative proportion of chips on the 1⅛ inch screen. The second is the relative distribution of chips on each of the five screens and the relative position of the screen at which the distribution is maximized. As will be explained more fully in a later discussion, it has now been discovered that it is important for a given chip stream to have a relatively narrow distribution range. For example, for the feed streams compared in Table 1, the presence of as small an amount of 1⅛ inch and ⅞ inch chips as possible is desired. Furthermore, the majority of these chips should preferably fall in the middle fraction, in this specific case, on the ⅝ inch screen.

Table 2 is an analysis showing chip thickness distribution data of the respective streams presented in Table 1. These chip thicknesses are measured by passing the stream through a premeasured slot so that the relative amount of chips in each of the respective A-E fractions can be determined. Thus, separation means 3 may accordingly comprise a screen means for separating chips on the basis of a predetermined thickness dimension, as hereinafter described. Because of the criticality of the thickness dimension of the chips during the delamination step, this test is considered to be an extremely important measure of uniformity. As in the case of the analysis by Williams screens, a narrow distribution of relatively uniform chips is required herein. More specifically, the thickness distribution of the Blackford and Colombo feed streams, as illustrated in Table 2-I and Table 2-II, respectively, are too broad to simultaneously permit selective delamination, efficient through-put of the feed stream, and substantial maintenance of fiber integrity. It has therefore been determined herein that, in general, chips having a thickness of less than about one-fourth inch are more susceptible to liquor penetration during pulping than chips having a larger thickness dimension.

This is accomplished (see Example 1, Table 1), by employing separation means 3, as for example, a ⅞ inch standard screen, such as the previously described Williams screen. However, when a standard ⅞ inch screen is employed without employing the subject chip reduction step, more chips which should be reduced in size pass through screen 3 and proceed on to the pulping operation. Alternatively, if a smaller sized standard screen is provided to minimize passage of these oversized chips, a much larger amount of chips than might be desirable must subsequently be delaminated or reduced in size by mechanical means. Thus, when the chip reduction step of this invention is employed, a more uniform chip stream is fed to the delaminating means. This provides for a significantly higher through-put rate, a higher overall pulp yield, and a reduction in the percent screen pulp rejects.

Furthermore, it has been found that a majority of knots and compression wood is located in the chip fraction 14. As indicated by the data in Table 2, both feed streams 12 and 14, respectively, exhibit a relatively broad chip thickness distribution, about 1% by weight of these chips having a thickness greater than one-half inch. Therefore if the opening between rolls 1 and 2, respectively, of the Blackford patent were set to effectively compress and delaminate the smaller chips, in this case having a thickness of one-fourth inch, or less, the larger sized chips would either cause a pronounced reduction in the feed through-put, or, alternatively, cause a significant portion of the feed stream to be damaged. Again, when a hard, thick chip arrives at the opening formed between the respective rolls, and its resistance to deformation exceeds the frictional forces attempting to draw it into the nip, it will slide back and forth therein and the chip stream will flow around it or pile up behind. On the other hand, if the chip resistance is not sufficiently great and the thickness exceeds the requisite thickness-compression relationship specifications, as expressed in the Blackford patent, a substantial amount of fiber damage will ensue. A nip setting which would permit passage of a large thickness fraction, such as fraction "E", to be effectively compressed according to the limits described by Blackford, will allow a significant amount of fraction "A" and fraction "B", respectively, a majority portion of both streams 12 and 14, to pass between the rolls without being subjected to the requisite delamination needed to improve yield. In contradistinction, the uniform feed stream of this invenion, i.e., Table 2, Run III (stream 20), can be effectively delaminated since substantially all of the large feed stream, in this instance, chips which are greater than ⅜ inch thick (fractions III-D and III-E) have been eliminated.

Referring again to FIG. 1, for purposes of providing a specific illustration of the subject process, screen 3 separates wood chip stream 12 into first and second fractions 14 and 15, respectively. In order to permit compression means 8 to effectively produce the previously described overall high yield of pulp, means generally designated as "16" is provided to convert first chip fraction 14 into a uniform, narrow distribution range product, namely, through-fraction 20, without compressing the chips, and without substantial reduction of the fiber length thereof. An illustrative method for preparing through-fraction 20 is shown within the dotted area of FIG. 1. First fraction 14 is fed by conveyor means 4 to a through-fraction feed screen 6 which separates out the oversized chip fraction 7. Through-fraction 20, the uniform, narrow distribution range material of the present invention then passes through screen 6 and, via conveyor means 10, is fed to compression means 8 where it is compressed and selectively delaminated.

Under conditions where the chip thickness distribution has been optimized through the use, for example, of the hereinafter described screen means which separates the chips in a given stream according to a predetermined thickness dimension, the most effective selective delamination takes place. In order to facilitate this optimum, selective delamination step, it may be desirable to provide a slightly larger thickness chip stream, preferably less than about three-eighths inch in thickness, and more preferably less than about one-fourth inch in thickness, to delaminator 8. The transverse dimension of the openings of screen 6, in such a case, is preferably about 12 mm (about one-half inch) or less, and more preferably about 10 mm (about three-eighths inch) or less. In any case, chips having relatively small thickness dimensions, without destroying the integrity of the fiber length prior to pulping, are most desirable. Therefore, a chip thickness of at least one twenty-fifth inch (about 1 mm) and more preferably at least about one-twelfth inch (about 2 mm) are most preferably for use herein.

The above screen, for separating chips according to a predetermined thickness dimension, can preferably be described as follows:

As opposed to standard screens which have substantially square-shaped openings, the openings in a screen means such as a slotted screen, are formed so that an elongated configuration is created. This particularly important in controlling the thickness of the chip feed stream of the present invention. Thus, when a maximum desirable chip thickness is first established, a standard square screen sized of a requisite maximum configuration will not permit the passage of chips therethrough unless the magnitude of a given chip is such that at least two of its three dimensions will pass through the screen opening. More specifically, if a ¼ inch maximum dimension is established, a chip which is 2 inches × ½ inch × ¼ inch will not pass through a standard screen sized to accommodate a ¼ inch maximum chip. Alternatively, the openings in a standard screen can be enlarged to permit the passage of a greater number of the chips by increasing the size of the openings to accommodate a ½ inch maximum chip, or larger. This will, of course, increase the occurrence of the number of larger thickness chips exiting the screening system and will somewhat reduce the effectiveness of the screening operation. In contradistinction, a slotted screen, or the like, can be sized, for example, due to its elongated configuration, to allow the passage of chips having an endless length and a maximum ¼ inch thickness. Therefore, in this latter case, only the predetermined thickness dimension is controlling so that chips of any width and length can pass through the screen if they meet the maximum requisite thickness parameter. In any case, when slotted screens are employed, it is desirable to provide chips in streams 15 and 20, respectively, which will have an optimum thickness without substantially damaging the chip or reducing the fiber length thereof. Accordingly, chips having a length-to-thickness ratio of at least 3:1, and preferably 5:1, are provided by the process of this invention. In a similar manner, the ratio of the longitudinal-to-transverse dimension of the slotted screen's elongated openings is in a ratio of 3:1, and preferably 5:1.

The above described slotted screens can be fabricated and substituted for standard perforated screens presently being used in commercial installations. For instance, assuming that the outer perimeter of the slotted screen is square in configuration, the screen slots can be arranged parallel or perpendicular to the path of a given chip stream merely by rotating the screen 90° in either direction. Alternatively, several banks of slotted screens may be arranged within a given peripheral frame member for purposes of forming any desired overall slotted screen configuration. Thus, by adjusting the position of the slotted screen banks within the peripheral frame, screening can be provided in a direction either parallel or perpendicular to the flow of a given chip stream.

Compression means 8, which selectively delaminates the chips, is formed preferably of a pair of rolls **8*a* and 8*b*, respectively, having a nip 8*c* disposed therebetween. The oversized stream 7 is carried by conveyor means 17 to a means 9 for reducing the size of the chips in stream 7 primarily with respect to their thickness dimension. Reducing means 9 provides the aforementioned reduction in thickness without imparting substantial compressive forces to the respective chips. Preferably, this size reduction is conducted employing devices which impart suitable mechanical action to the chips, such as a hammer mill or other like mechanical devices. Care is, of course, maintained with regard to size reduction means 9 so that undue substantial damage is not imparted to the chip feed stream during this step. Stream 4*a* exits reducing means 9 and is recycled to screen 6 on conveyor means 19. Substantial amounts of chip stream 4*a* will pass through screen 6 and become part of through-fraction 20. Any oversized chips not sufficiently reduced to size so as to pass through screen 6 will be reconveyed to reducing means 9 and will undergo subsequent size reductions, as necessary. Through-fraction 20 is then compressed and delaminated by compression means 8. Delaminated stream 21 exiting therefrom is conveyed by conveyor means 2*a*, preferably for recombination with smaller fraction 15, to form composite stream 22. However, it is quite clear that streams 15 and 21, respectively, can be pulped separately. Stream 22** is then transported to the pulping system employed and is converted to the uniform, overall high yield pulp of the present invention by conventional pulping techniques.

EXAMPLE 1

This example shows the chip size (Table 1) and chip thickness (Table 2) distribution feed streams 12 (Run I), 14 (Run II), and 20 (Run III), respectively (see FIG. 1). Streams 12 and 14 correspond to the feeds employed in U.S. Pat. No. 3,393,634 to Blackford and Canadian Pat. No. 677,418 to Colombo et al., respectively. Feed stream 20 is uniform through-fraction of the present invention. Table 1 indicates the relatively chip size based on any chip dimension (longitudinal or transverse). Table 2 denotes the relative thickness of the chips in each of the above chip streams.

Table 1

| Fraction | Williams Screen Size (inches) | Weight % of Chips Retained on Each Screen | | |
|---|---|---|---|---|
| | | I | II | III |
| A | 1 1/8 | 6.1 | 12.9 | 0.4 |
| B | 7/8 | 28.4 | 65.9 | 23.1 |
| C | 5/8 | 30.0 | 20.7 | 47.4 |
| D | 3/8 | 29.2 | 0.4 | 25.1 |
| E | 3/16 | 6.2 | 0.1 | 4.0 |

With respect to Table 1, Run I shows a broad distribution of chips in the U.S. Pat. No. 3,393,634 feed stream, the range of distribution being maximized in the C fraction (30%). A significant number of chips (6.1%) are present in the A fraction.

Table 1, Run II, exhibits a relatively narrower distribution than Run I, only about 0.5% of the chip stream being located in the D and E fractions. In the case of Run II, however, the chip distribution is maximized about the larger B fraction (65.9%). And, an even greater amount of chips (12.9%) is present in the A fraction than is contained in comparable Run I-A.

Table 1, Run III, which is the analysis of the process feed stream of the present invention, has only a minimal amount of chips (0.4%) in the A fraction, and provides a relatively narrow distribution range maximized in the C fraction.

Table 2

| Fraction | Chip Thickness (inches) | Weight % of Chips Based on Thickness | | |
|---|---|---|---|---|
| | | I* | II | III |
| A | < 1/8 | 10.0 | 0.6 | 5.5 |

Table 2-continued

| Fraction | Chip Thickness (inches) | | Weight % of Chips Based on Thickness I* | II | III |
|---|---|---|---|---|---|
| B | > 1/8 ; | < 1/4 | 75.0 | 71.6 | 82.5 |
| C | > 1/4 ; | < 3/8 | 13.2 | 25.7 | 12.0 |
| D | > 3/8 ; | < 1/2 | 0.8 | 1.3 | — |
| E | > 1/2 | | 1.0 | 0.8 | — |

*Average of two different runs from samples taken on two separate days

With respect to Table 2, Run I provides a broad thickness distribution of chips in the U.S. Pat. No. 3,393,634 feed stream, the range of distribution being maximized in the B fraction (75.0%). A significant number of chips is present in all of the A-E fractions, 0.8% and 1.0%, respectively, of these chips being present in the D and E fractions.

Table 1, Run II, also exhibits a broad thickness distribution range which, in this case is maximized in the B fraction (71.6%). As in the case of Run I, chips having thicknesses in all of the A-E fractions are present, 1.3% and 0.8%, respectively, by weight being present in the D and E fractions. Again, this second run emulates the feed stream of Colombo et al.

Finally, Table 2, Run III, the chip thickness analysis of the present invention, provides a narrow chip thickness distribution maximized in the B fraction (82.5%). As opposed to Runs I and II of Table 2, Run III contains no chips having thicknesses in the respective D and E fractions. Furthermore, 15% of the chip stream, and 27.8% of the Colombo et al. chip stream, as opposed to only 12% of the subject feed stream, contain chips having a thickness of greater than one-quarter inch.

EXAMPLE 2

A stream of red fir chips, i.e., chip stream 12 of FIG. 1 of the subject invention, having a screened yield of 43.1%, a permanganate number of 33, and containing 5.6% pulp screen rejects, was subjected to treatment by both the process of Canadian Pat. No. 677,418 to Colombo et al. and the process of the present invention, respectively.

In the pulp and paper industry it is common practice to maintain the pulp screen rejects level below 2%. An amount of screen reject above 2% is generally not acceptable since this clogs the screening system, terminating its operation or, at best, making it very inefficient. Pulp screen rejects are defined as the pulp particles remaining on a 0.008-inch screen when the pulp is passed therethrough. The pulp material passing through the screen is the desirable product which forms the screened pulp yield.

For purposes of definition, the "permanganate number" of the pulp is a laboratory test measuring the lignin associated with pulp fibers and, as such is a measure of the degree of pulping. Thus, higher permanganate numbers mean that more residual lignin remains associated with the pulp, and that a less effective degree of pulping has occurred.

A chip stream, analogous to stream 12, was subjected to an initial separation employing primary separation means. In the case of the Colombo et al. process a $\frac{7}{8}$ inch diameter perforated chip screen was employed to separate a 17% by weight first chip fraction and an 83% by weight second chip fraction. In the experiment demonstrating the subject process, a first fraction was produced by separating from the initial chip stream those chips which did not pass through a 10 mm slot. Thus, 14% by weight of the chips were found to be greater than 6 mm in thickness (first chip fraction), while 86% of the chips had a thickness dimension less than 6 mm (second chip fraction).

Tests were conducted on each of first and second chip fractions to determine, based on total wood fed to the digester, (a) the pulp screen yield, and (b) percent pulp screen rejects, the total pulp yield of a given stream of chips being the sum of (a) and (b). Thus, the higher the amount of pulp screen rejects, the longer the required cook times for pulping a given stream of chips, the greater the amount of caustic needed during processing, and the higher the capital costs.

The screen yield and percent pulp screenings of the second fraction (the Colombo process) was 45.3% and 3.6%, respectively, as opposed to 44.5% and 1.3% for the process of the present invention. With respect to the second chip fraction, the Colombo process provided for 40.3% screen yield and 14.9% pulp screenings, while the subject process, employing a 6 mm slot as the primary separation means, exhibited a 38.4% screen yield and had 21.7% pulp screenings.

In the process of this invention, first chip fraction was reduced in size by chip size reducer, which in this case was a mechanical chipper, i.e., a Carthage 34-inch, 10 knife, mechanical chipper. The resultant thickness of the reduced chip stream was measured using a 10 mm chip slot. Any chips whose size was over 6 mm was further reduced and rescreened, the 6 mm or less chips forming the through-fraction.

The through-fraction was fed to a delaminating means having a nip setting of about 0.04 inch. The delaminator employed was an HMC Corporation Model No. CC 2407-10 chip compression unit having rolls which are six inches wide and two feet in diameter. The delaminated chips exhibited about a 45% pulp screen yield and contained about 2% pulp screen rejects. This is compared to a 43% pulp screen yield and about 6% pulp screen rejects for the chip fraction of the Colombo process after delamination.

Several conclusions are quite evident from observing the above data. First, the Colombo et al. process produces about three times the amount of pulp screen rejects as the process of the present invention. More specifically, the process of the present invention provides a pulp product containing only about 2% pulp screen rejects, the amount equivalent to the 2.0% acceptable level, as provided by the pulp and paper industry. Thus, as opposed to the present process, the pulp screen rejects level produced by the process of Colombo et al. must be lowered by, for example, repulping two-thirds of the screen rejects present, which is both expensive and provides for a more nonuniform pulp product due to the disparity in relative cooking times.

Second, the permanganate number of pulp made from both the original chip stream is 33. The permanganate number of the delaminated stream prepared according to the teaching of Colombo et al. is 36. Thus, when the Colombo et al. teachings are followed, as indicated by the above permanganate numbers, there was no enhancement of the chips for purposes of lignin removal. Conversely, when the process of the present invention was employed, a significant amount of lignin is removed during pulping, as indicated by a lowering of the permanganate number from 33 to 28 for the resultant recombined stream.

In order to demonstrate the respective differences in the previously described through-put rates of the Colombo et al. process and the process of the present invention, the chip flow rate in pounds per second through the delaminator was determined, including the interruption time necessary to remove chips which plugged the roll press nip. More specifically, when an interruption occurred, the chip feed was stopped, and the rolls were separated until the plugged chip passed therebetween. The normal operation was then immediately resumed. The Colombo et al. process had interruptions at various nip settings in a range of from 0.040 inch to 0.130 inch, inclusively, while the process of the present invention had no interruptions at 0.020 inch and 0.040 inch settings, respectively, a much narrower range of nip openings. It is also clear that delaminating at the higher gap settings is not an effective mode of operation. Thus, the subject process provides for both more efficient operation and for more effective delamination.

Chips prepared according to the process of Colombo et al., and weighing 21.5 pounds, were fed to the above described delaminator having a nip setting of 0.040 inch. The time for delamination of that sample was 252 seconds. Similarly, 24.5 pounds of chips representing the through-fraction of the process of the present invention were also fed to the same delaminator system at the same nip setting (0.040 inch) in only 61 seconds. In the case of the Colombo process, the through-put rate was equivalent to about 7.4 tons per day per lineal foot of roll press width, while the subject process had a through-put rate equivalent to about 34.8 tons per day per lineal foot. Accordingly, the process of this invention exhibited an average chip flow rate 4.7 times as great as the process of Colombo et al. In addition, the chip flow rate for the subject process was limited by the screw feeder employed in the above experiments. Actually, the delaminator capacity is considerably higher than 34.8 tons per day per lineal foot so that a much higher through-put can actually be achieved if a high speed conveyor means is employed in conjunction with the subject process.

The overall yield of pulp product, as defined on page 4, beginning at line 12 of the specification, is based on the efficiency of delamination and the final product pulp conversion. In the above experiments, the overall yield of pulp product, according to the process of Colombo et al., is only about 3.0 tons per day. However, even though the feed conveyor is insufficient to feed chips at a maximum through-put rate, the process of the present invention provides a 15.6-ton per day overall yield. Accordingly, the overall yield of pulp produced by the subject process is at least twice and, preferably, at least five times that produced according to the Colombo et al. process. More specifically, an overall pulp yield of preferably at least 15 tons per day and, more preferably at least 25 tons per day can be provided if the process of the present invention is employed.

We claim:

1. A selective delamination process for producing a high yield, uniform pulp having reduced pulp screen rejects, which comprises:

a. conveying a mill-wood chip stream to a primary means for separating by size the chip stream into respective first and second fractions on the basis of a chip thickness of about one-fourth inch, said first fraction consisting of wood chips having a thickness equal to or greater than about one-fourth inch and being retained by said primary separation means, and said second fraction consisting of wood chips having a thickness of less than about one-fourth inch;

b. conveying said first chip fraction to a means for reducing the size of said first chip fraction without imparting substantial compressive forces thereto and without substantial reduction in the fiber length of the chips in said first wood chip fraction;

c. conveying said reduced chip fraction to a secondary means for separating by size said reduced chip fraction into respective oversized and through-put chip fractions, the oversized chip fraction consisting of wood chips having a thickness equal to or greater than about one-fourth inch and being retained by said secondary separation means and said through-put fraction consisting of wood chips having a thickness of less than about one-fourth inch, said through-put fraction being more susceptible to liquor penetration during pulping than chips having a larger thickness;

d. reconveying said oversized chip fraction to said reducing means for further reduction of said oversized chips and reconveying said reduced chips produced thereby to said secondary separation means;

e. selectively delaminating said through-put fraction, at a substantially high through-put rate, by feeding same to a compression means; and f. pulping said second chip fraction and said selectively delaminated fraction, respectively to produce wood pulp.

2. The process of claim 1, wherein from about 5% by weight and up to about 25% by weight, based on the total weight of said mill-wood chip stream, is retained by said primary separation means.

3. The process of claim 1, wherein either one of said primary and secondary separation means comprises a screen means.

4. The process of claim 1, wherein either one of said primary and secondary separation means comprises a screen means having elongated openings.

5. The process of claim 4, wherein the ratio of the longitudinal-to-transverse dimension of said elongated opening is at least 3:1.

6. The process of claim 5, wherein said longitudinal-to-transverse dimension ratio is 5:1.

7. The process of claim 4, wherein the transverse dimension of the elongated openings in the primary screen separation means is less than the transverse dimension of the elongated openings in the secondary screen separation means.

8. The process of claim 7, wherein, prior to said size reduction step, said first chip fraction is conveyed to said secondary separation means for separating said first fraction into said respective oversized and through-put chip fractions, said oversized fraction being retained by said secondary separation means and conveyed to said reducing means and said through-put fraction being selectively delaminated.

9. The process of claim 1, wherein the overall yield of pulp produced is at least 15 tons per day.

10. The process of claim 1, wherein the amount of pulp screen rejects is not more than about 2%.

* * * * *